United States Patent [19]

Abbadessa et al.

[11] 4,241,280

[45] Dec. 23, 1980

[54] LIGHT INTEGRATOR CIRCUIT WITH BUILT-IN ANTICIPATION

[75] Inventors: Joseph J. Abbadessa, Westwood; Bruce K. Johnson, Andover, both of Mass.

[73] Assignee: Polaroid Corporation, Cambridge, Mass.

[21] Appl. No.: 51,681

[22] Filed: Jun. 25, 1979

[51] Int. Cl.[3] ..... H05B 41/32

[52] U.S. Cl. ..... 315/151; 250/214 P; 315/241 P; 354/33; 354/60 F

[58] Field of Search ..... 315/151, 159, 241 P; 250/214 P; 354/33, 60 F, 145

[56] References Cited

U.S. PATENT DOCUMENTS

| | | | |
|---|---|---|---|
| Re. 27,867 | 1/1974 | Years | 250/214 P X |
| Re. 29,927 | 3/1979 | Ichihashi | 354/60 R X |
| 3,381,230 | 8/1968 | Gilbert et al. | 328/127 |
| 3,620,143 | 11/1971 | Burgarella | 356/222 X |
| 3,641,891 | 2/1972 | Burgarella | 250/214 P X |
| 3,727,143 | 4/1973 | Garrett | 328/117 X |
| 3,774,072 | 11/1973 | Ogawa | 315/151 |
| 3,809,992 | 5/1974 | Negishi | 250/214 P X |
| 3,869,642 | 3/1975 | Sabanci | 315/151 |
| 3,875,471 | 4/1975 | Buck | 315/151 |
| 3,972,626 | 8/1976 | Laskowski | 250/214 P X |
| 4,016,496 | 4/1977 | Eastcott | 328/35 |
| 4,019,092 | 4/1977 | Stiller | 315/159 |
| 4,029,992 | 6/1977 | Engelstatter | 315/156 |
| 4,115,745 | 9/1978 | Egan | 331/17 |

*Primary Examiner*—Eugene R. LaRoche
*Attorney, Agent, or Firm*—Edward S. Roman

[57] ABSTRACT

A quench strobe includes a light integrator circuit with an anticipation network which enables the quench to be anticipated by a predetermined time corresponding to the reaction time of the strobe quenching circuitry so as to avoid overexposure under conditions where the photographic subjects are close to the camera or under conditions of relatively high scene light reflectance.

16 Claims, 4 Drawing Figures

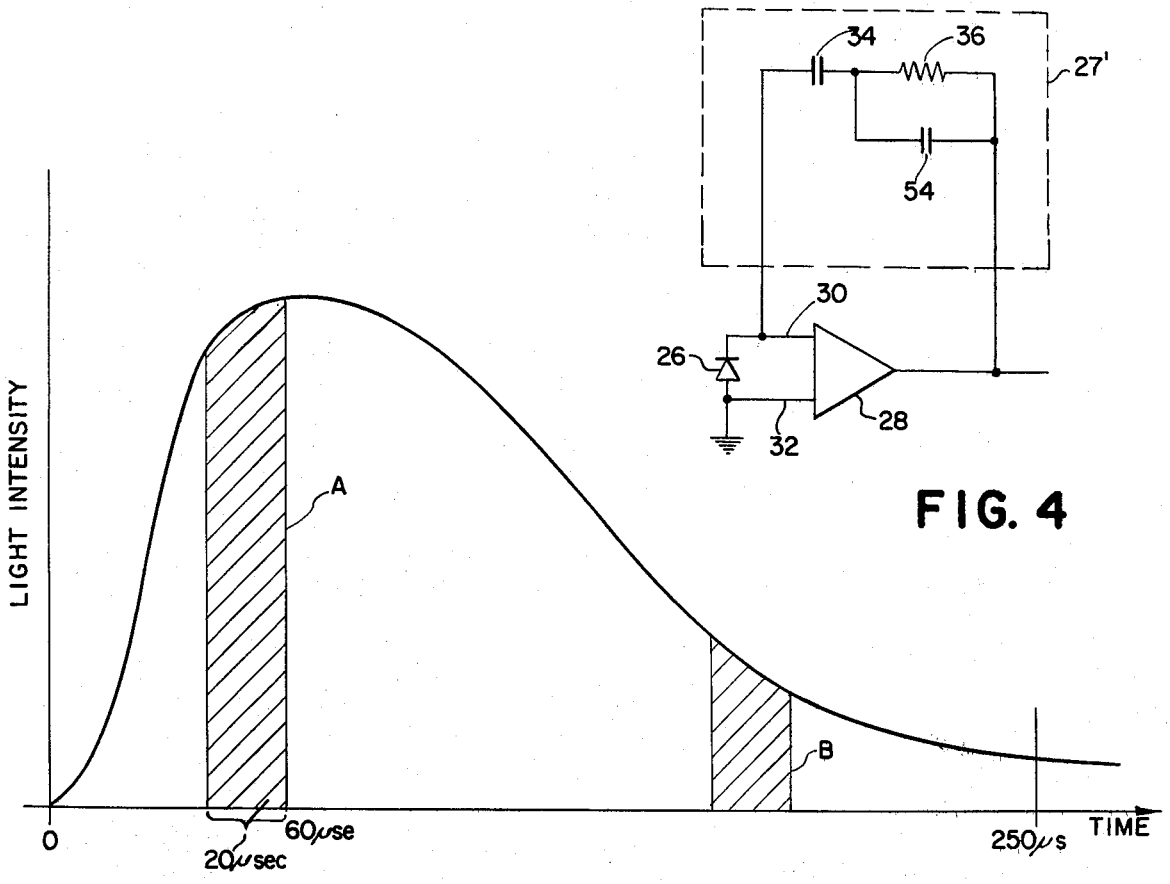
FIG. 4
FIG. 2
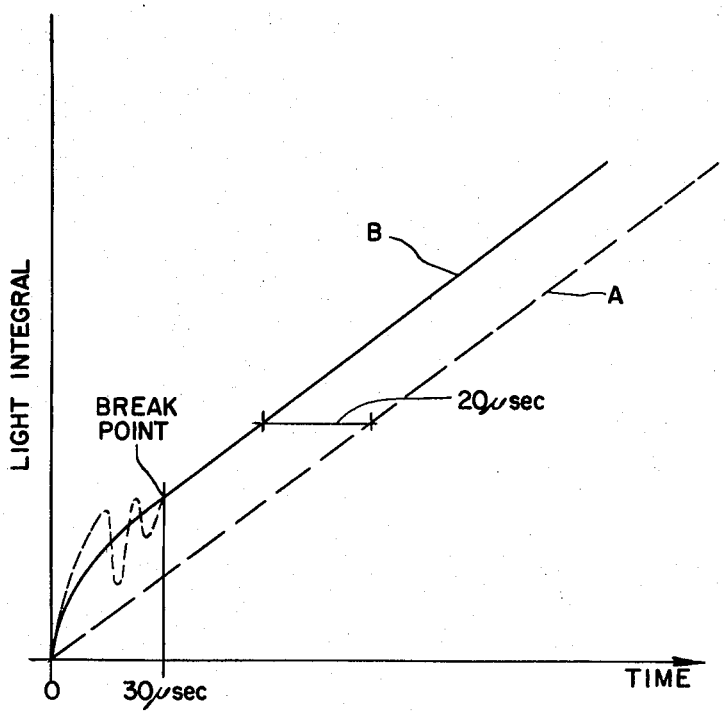
FIG. 3

LIGHT INTEGRATOR CIRCUIT WITH BUILT-IN ANTICIPATION

BACKGROUND OF THE INVENTION

1. Field of the Invention

This invention relates generally to an electronic flash having a light integrator circuit which provides an anticipated quench, and more particularly, to an electronic flash having a light integrator circuit which enables the quench to be anticipated by a predetermined time in order to avoid overexposure under conditions where the photographic subjects are close to the camera or cases of relatively high scene light reflectance.

2. Description of the Prior Art

Circuits for automatically controlling and terminating the operation of a light flash source are well known in the art. Such circuits are found to have particular application in the photographic fields where they are used to control the period of time for which an electronic photo flash lamp is operative. The electronic flash lamp controlling circuits generally include a photosensitive or photoresponsive element located close to its associated camera and are operative to initiate operation of the electronic flash lamp when the camera shutter is opened, and to terminate operation of the electronic flash lamp when a desired total amount of light from the subject has been received by the photoresponsive device. Electronic flash controlling circuits of the prior art have, for the most part, used some kind of light integrating technique to derive an electrical signal representative of the total light received by the photosensitive device over the time period of interest. One type of light integrating circuit which is of particular interest because of its highly linear output signal is disclosed in U.S. Pat. No. 3,620,143, entitled "Automatic Exposure Control System with Fast Linear Response", by J. Burgarella, issued Nov. 16, 1971, in common assignment herewith.

Many of the prior art electronic flash control circuits have not provided control which is sufficiently accurate over a broad range of camera-to-subject distances. In particular, such control circuits have been particularly deficient in providing the desired flash control response for photographic subjects located at a relatively short distance from the camera or in cases of relatively high scene light reflectance.

One such arrangement for providing a fast response under conditions of close camera-to-subject distances is disclosed in U.S. Pat. No. 3,875,471, entitled "Photo Flash Source Control Circuit", by R. Buck, issued Apr. 1, 1975, which shows a light integrating control circuit having a programmed current source for varying the reference voltage at which a comparator is triggered by the output signal from the scene light integration circuit. Thus, under conditions of close camera-to-subject distances the programmed current source provides a relatively low reference voltage to the comparator so that the comparator is triggered earlier by the output signal from the scene light integrating circuit to provide a fast response. One disadvantage of this arrangement is that the programmed current source must be turned on in exact synchronism with the triggering of the flash tube in order that the variable reference voltage be applied to the comparator in a consistent manner for different exposures.

Another arrangement for avoiding overexposure which often occurs with conventional electronic flash apparatus when taking close-up photographs is disclosed in U.S. Pat. No. 3,896,642, entitled "Control Circuit for Electronic Flash Apparatus", by M. Sabanci, issued Mar. 4, 1975, which shows a capacitor, a resistor, and an inductance dimensioned so that the time constant formed from the resistor and capacitor equals the time constant formed by the resistor and inductance. This enables the response time of the control circuit to be measured in nanoseconds rather than in microseconds. However, this arrangement as well as other similar arrangements are only suitable for use with more conventional light integration circuits of the type having a serially connected photoresponsive element and light integrating capacitor and are not readily adaptable for use with the linear light integration circuit as described in the aforementioned U.S. Pat. No. 3,620,143.

Therefore, it is a primary object of this invention to provide a light integration circuit having a highly linear output response under normal ambient light conditions, which is also suitable for use in an electronic flash control circuit to provide the required fast output response with a predetermined anticipation time to correct for the reaction time of the strobe quenching circuit under conditions of close camera-to-subject distances or high scene light reflectance.

It is also an object of this invention to provide an electronic flash of the quench type having a highly linear light integration circuit for satisfactorily controlling the quench under conditions of close camera-to-subject distance or high scene light reflectance.

Other objects of the invention will be in part obvious and will in part appear hereinafter. The invention accordingly comprises a circuit and system possessing the construction, combination of elements and arrangements of parts which are exemplified in the following detailed disclosure.

SUMMARY OF THE INVENTION

A scene light integrator with generally uniform anticipation comprises a photoresponsive element together with means for connecting the photoresponsive element to operate in a constant current mode for a select light intensity incident to the photoresponsive element. Light integrating means are provided to respond to the current output of the photoresponsive element for providing an output signal representative of the integral of the light intensity incident to the photoresponsive element as anticipated by a predetermined factor. The light integrating means comprises a resistive and capacitive component serially connected with respect to each other to provide the anticipation factor together with means for filtering the light integration signal. The means for connecting the photoresponsive element and the constant current mode preferably comprises an operational amplifier having two input terminals connected across the photoresponsive element to present an apparent input impedance of substantially zero. The amplifier further includes an output terminal connected to one side of the serially connected resistive and capacitive components with the other side of the serially connected resistive and capacitive components connecting to one of the input terminals of the amplifier so as to define a feedback path with respect to the amplifier. The light integration circuit is particularly suitable for use with a quench strobe wherein the quench circuit requires a predetermined reaction time from receipt of the quench trigger signal until full extinguishment of the illuminating flash of light. The anticipation factor provided by the light integration circuit corresponds to the reaction time of the quench circuit to provide an instantaneous quench under conditions of close camera-to-subject distance or high scene light reflectance.

DESCRIPTION OF THE DRAWINGS

The novel features that are considered characteristic of the invention are set forth with particularity in the appended claims. The invention itself, however, both as to its organization and its method operation, together with other objects and advantages thereof will be best understood from the following description of the illustrated embodiment when read in connection with the accompanying drawings wherein:

FIG. 2 is a graphical representation of the variation in light intensity versus time for an illuminating flash of light as provided by an electronic flash;

FIG. 3 is a graphical representation of the light integration output signal from the light integration circuit of this invention in comparison to a non-anticipated scene light integration signal; and FIG. 4 is a schematic circuit diagram of one alternative arrangement for a portion of the electronic flash and light integration circuit of FIG. 1.

DESCRIPTION OF THE PREFERRED EMBODIMENT

Figure 1:
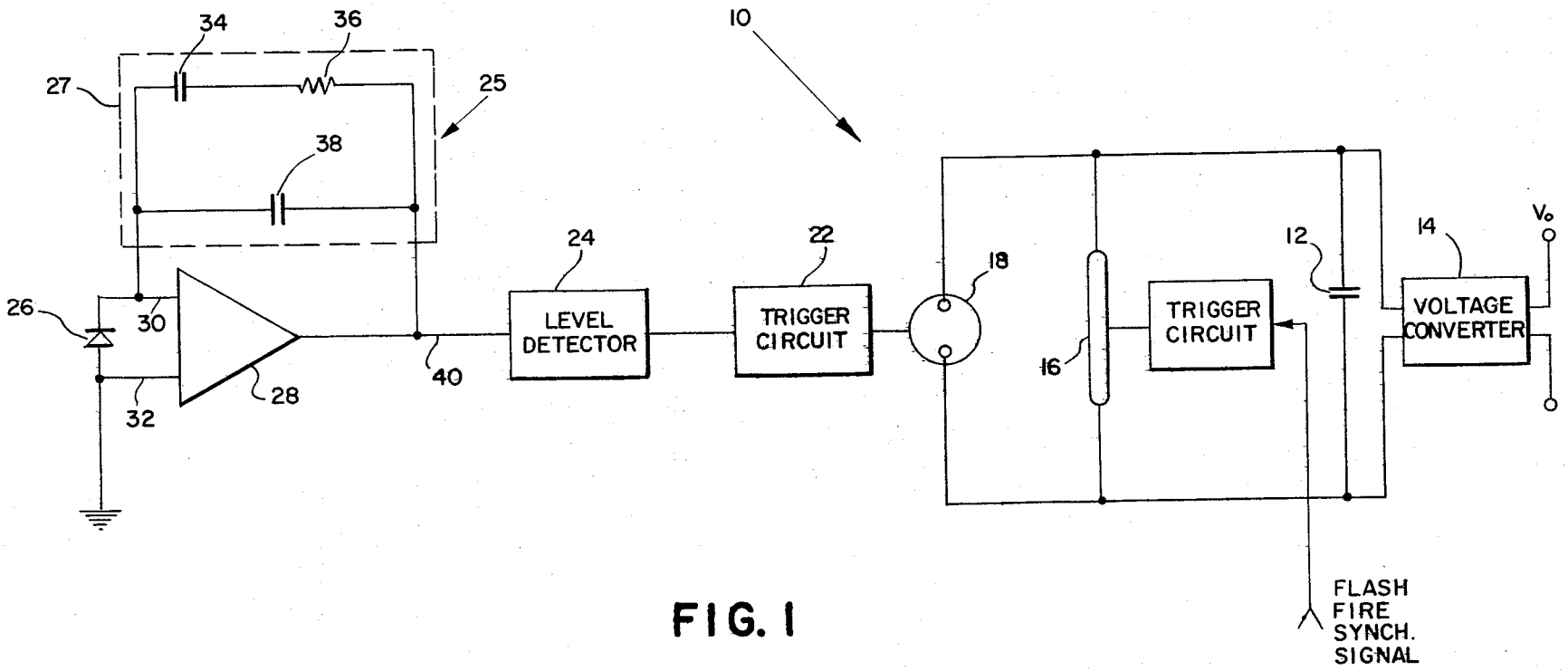
FIG. 1 is a schematic circuit diagram of the electronic flash and light integration circuit of this invention.

Referring now to FIG. 1, there is shown at 10 a schematic wiring diagram for an electronic flash apparatus comprising a main storage capacitor 12 which may be charged up to an operating voltage by a conventional voltage converter circuit as shown at 14. The voltage converter 14 operates in a conventional manner to convert a DC voltage, as may be derived from a battery (not shown) which can be in the order of six volts, to a suitable strobe operating voltage such as 350 volts. A flash tube 16 and a quench tube 18 for interrupting the flash discharge are connected in parallel relation with respect to the storage capacitor 12. The flash tube 16 can be ignited by a trigger circuit 20 of any conventional form which is set in operation by the closing by the conventional synchronous contacts of a camera, operating in synchronism with the camera shutter, in the usual conventional manner.

The quench tube 18 may be ignited by another conventional trigger circuit 22 which is connected to respond to a sudden change in the output signal level of a conventional level detector 24 which may be a Schmitt trigger.

The level detector 24, in turn, responds to the output signal level from a light integrating circuit 25 reaching a predetermined level corresponding to the desired exposure value. The light integrator circuit 25 comprises a photoresponsive element 26 connected across the input terminals 30, 32 of an operational amplifier 28 of the differential variety. When considered ideally, the amplifier 28 has infinite gain and infinite input impedance and a zero output impedance. The input circuitry of the amplifier 28, however, is structured such that the apparent input impedance or that "seen" by the photoresponsive element 26 is substantially zero thereby functioning in a manner which permits the photoresponsive element 26 to operate in a current mode. Consequently, the current generated by the photoresponsive element is limited substantially only by its own internal impedance. To accomplish this effect, a feedback path comprising a feedback circuit as shown generally at 27 is connected between one input terminal 30 of the operational amplifier 28 and an output terminal 40 from the operational amplifier 28.

With the feedback arrangement described, any difference of potential supplied by the photoresponsive element 26 across input terminals 30 and 32 will operate to cause a current of opposite polarity to be produced through feedback circuit 27. As a consequence, the feedback circuit 27 provides a substantially instantaneous feedback signal of opposite polarity which serves to counteract any differential signal voltage impressed by the photoresponsive element 26 across the input terminals 30 and 32. Thus, although the amplifier 28 has a very high input impedance, the photoresponsive element 26, when connected in the aforementioned manner experiences only a very low input impedance to the amplifier 28. Therefore, the current output of the photoresponsive element 26 is directed into the feedback circuit 27. In this manner, the photoresponsive element 26 is connected to operate in a constant current mode of operation under conditions of nonvarying scene light intensity to provide a substantially linear output response at output terminal 40, as is more fully described in U.S. Pat. No. 3,620,143, supra.

Referring now to FIG. 2, there is shown a graphical representation of the variation in the output flash light intensity from the flash tube 16 as a function of time. As is readily apparent, the output flash light intensity from the flash tube 16 rises rapidly to a peak value and thereafter trails off with a gently decreasing slope. A typical electronic flash output pulse may provide significant illumination for a period of 250 microseconds with the peak output light intensity occurring at 60 microseconds subsequent to the initial firing of the tube.

As is readily apparent, in order to avoid overexposure when taking close-up photographs or under conditions of high scene light reflectance, it is necessary to quench the strobe light quickly and with a minimum of delay. However, as previously discussed, the trigger circuit 22 and the quench tube 18 have a finite reaction time from the initial triggering of the level detector 24 to the time of full extinguishment of the illuminating flash of light. Whereas the trigger circuit 22 may typically include an SCR or thyristor gate, a portion of this reaction time may be attributable to the finite time required to turn on the SCR or thyristor gate. In addition, the quench tube 18 cannot instantaneously discharge the remaining charge from the main storage capacitor 12 and requires a finite time to fully extinguish the illuminating flash of light subsequent to being triggered into conduction by the trigger circuit 22. As is readily apparent, under conditions of peak flash light intensity the time required for the quench tube to discharge the remaining charge of the capacitor is also at a maximum. Thus, the cumulative reaction time of the trigger circuit 22 and the quench tube 18 under conditions of peak flash light intensity may be in the order of 20 microseconds as shown graphically by the shaded area in the graph of FIG. 3 and decreases slightly with the decrease in the flash light intensity. For close-up subjects or high scene light reflectance where the flash light must be quenched quickly near its peak levels of intensity, it can be seen that a 20 microsecond delay in the actual extinguishment of the illuminating flash of light can result in a significant overexposure in the order of almost 60 percent. For photographic subjects further away from the camera, the illuminating flash of light need not be quenched as quickly and the overexposure resulting from the delayed reaction time of the trigger circuit 22 and the quench tube 18 as shown graphically by the shaded area B represents a substantially smaller proportion of the overall exposure light thereby introducing a substantially smaller overexposure error. Therefore, although the delays in quench are approximately equal for the two given conditions, the relative errors in exposure are not, which results in non-linear exposure tracking.

The feedback circuit 27 of this invention provides a degree of anticipation which corresponds to the reaction time of the trigger circuit 22 and quench tube 18. This anticipation factor is provided in the feedback circuit 27 by serially connecting a resistive element 36 with a capacitive element 34. The output integration signal response at output terminal 40 for this arrangement is shown in curve B in FIG. 3 and can be seen to anticipate the conventional integration output signal A (phantom lines) by 20 microseconds. The RC time constant for the capacitor 34 and resistor 36 determines the breakpoint (instant that slope of curve A equals slope of curve B) for the curve B which for the aforementioned example is shown at about 30 microseconds. Varying the value of the resistor 36 also causes a corresponding variation in the anticipation time (time between curves A and B) as well as a corresponding change in the RC time constant which effects the breakpoint of the curve B.

Further means must be provided to filter or dampen the output response of the feedback circuit 27 during the initial charge-up time of the capacitor 34 in order to prohibit transient oscillations which can occur under certain conditions as shown in phantom in FIG. 3. Such filter or dampening means may comprise a capacitor 38 connected in parallel relation with respect to the serially connected resistor 36 and capacitor 34. Thus, the capacitor 38 provides for a smooth transition from the initiation of scene light detection and integration to the breakpoint where the output integration signal approaches the desired slope. The slope of the linear portion of the scene light integration curve B is determined by the combined values of capacitors 34 and 38 which in the case of parallelly connected capacitors equals the summation of the values of capacitors 34 and 38 in FIG. 1. Capacitor 34 preferably has a greater value than capacitor 38 and may for the illustrated example be in the order of two and a half times greater than the dampening capacitor 38.

Thus, an electronic flash of the quench type is provided with a scene light detecting and integrating circuit for providing a scene light integration signal having a degree of anticipation corresponding to the reaction time of the trigger circuit 22 and quench tube 18. As is readily apparent, the light integration output signal B as shown in FIG. 3 provided by the light integration circuit 25 assumes the same highly linear relationship as provided by the light integration circuit as described in U.S. Pat. No. 3,620,143, supra. The anticipation provided by the light integration output signal B, which for purposes of the aforementioned illustration is in the order of 20 microseconds, corresponds to the 20 microsecond reaction time of the trigger circuit 22 and quench tube 18 thereby permitting flash photographs of photographic subjects located at close distances to the camera or under conditions of high scene light reflectance without overexposure. For photographic subjects located at greater distances from the flash or under conditions of low scene light reflectance, it is readily apparent that the anticipation factor becomes less significant. Thus, the light integration circuit 25 could also be used in the manner of U.S. Pat. No. 3,869,642, supra., to simultaneously control the duration of a photographic exposure interval by providing the scene light integration signal to a level detector which when triggered provides a shutter blade closing command signal. The 20 microsecond anticipation factor provided by the light integration circuit 25 is negligible in comparison to the opening and closing shutter blade times and therefor has an insignificant effect with regard to a normal daylight photograph taken either without an electronic flash or with a fill flash. The filter capacitor 38 further operates to maintain the output signal level from the light integrator above the minimum required trigger level of the level detector after the scene light is blocked from reaching the photoresponsive element by the closing shutter blade elements.

Referring now to FIG. 4, there is shown at 27' an alternate arrangement for the feedback circuit of this invention wherein like numbers designate previously described elements. The means for filtering the output response of the feedback circuit 27 during the initial charge-up time of the capacitor 34, however, is changed to comprise a capacitor 54 connected in parallel relation only with respect to the resistor 36. For this arrangement, the slope of the linear portion of the scene light integration curve B is determined primarily by the value of the capacitor 34 and the capacitors 34 and 54 preferably approximate each other in value.

Since certain changes may be made in the above exposure control systems without departing from the scope of the invention herein involved, it is intended that all matter contained in the above description or shown in the accompanying drawings shall be interpreted as illustrative not illuminating sense.

What is claimed is:

1. A light integrator with generally uniform anticipation comprising:

a photoresponsive element;

means for connecting said photoresponsive element to operate in a constant current mode for a select light intensity incident to said photoresponsive element; and light integrating means responsive to the current output of said photoresponsive element for providing an output signal representative of the integral of the light intensity incident to said photoresponsive element as anticipated by a predetermined factor, said light integrating means comprising a resistive and capacitive component serially connected with respect to each other to provide said anticipation factor together with means for filtering the light integration signal from said resistive and capacitive components.

2. The light integrator circuit of claim 1 wherein said means for connecting said photoresponsive element in said constant current mode comprises an operational amplifier having two input terminals connected across said photoresponsive element to present an apparent input impedance of substantially zero and an output terminal connected to one side of said serially connected resistive and capacitive components with the other side of said serially connected resistive and capacitive components connecting to one of said input terminals to said amplifier so as to define a feedback path with respect to said amplifier.

3. The light integrator of claim 2 wherein said filter means comprises another capacitive component in parallel connection with respect to said serially connected resistive and capacitive components.

4. The light integrator of claim 2 wherein said filter means comprises another capacitive component in connection only with respect to said resistive component.

5. A light integrator with generally uniform anticipation comprising:

a photoresponsive element;

an operational amplifier having two input terminals connected across said photoresponsive element to present an apparent input impedance of substantially zero thereby permitting said photoresponsive element to operate in a current mode, said amplifier further comprising an output terminal; and feedback means interconnecting the output terminal of said amplifier to one of said input terminals to provide an output signal at said output terminal representative of the integral of the light intensity incident to said photoresponsive element as anticipated by a predetermined factor.

6. The light integrator of claim 5 wherein said feedback means comprises a resistive and capacitive component serially connected with respect to each other to provide said anticipation factor together with means for filtering the light integration signal from said resistive and capacitive components.

7. The light integrator of claim 6 wherein said filter means comprises another capacitive component in parallel connection with respect to said serially connected resistive and capacitive components.

8. The light integrator of claim 6 wherein said filter means comprises another capacitive component in connection only with respect to said resistive component.

9. A quench strobe comprising:

a flash tube;

circuit means responsive to an applied trigger signal for effecting a discharge of current through said flash tube to produce an illuminating flash of light;

quench means responsive to another subsequently applied trigger signal for extinguishing said flash of light, said quench means having a predetermined reaction time from receipt of said other trigger signal to full extinguishment of said illuminating flash of light;

a photoresponsive element;

means for connecting said photoresponsive element to operate in a constant current mode for a select light intensity incident to said photoresponsive element;

light integrating means responsive to the current output of said photoresponsive element for providing an output signal representative of the integral of the light intensity incident to said photoresponsive element as anticipated by a predetermined time corresponding to said reaction time of said quench means, said light integrating means comprising a resistive and capacitive component serially connected with respect to each other to provide said anticipation factor together with means for filtering the light integration signal from said resistive and capacitive components; and level detecting means responsive to said output signal from said light integrating means reaching a select level for providing said other trigger signal.

10. The quench strobe of claim 9 wherein said means for connecting said photoresponsive element in said constant current mode comprises an operational amplifier having two input terminals connected across said photoresponsive element to present an apparent input impedance of substantially zero and an output terminal connected to one side of said serially connected resistive and capacitive components with the other side of said serially connected resistive and capacitive components connecting to one of said input terminals to said amplifier so as to define a feedback path with respect to said amplifier.

11. The quench strobe of claim 10 wherein said filter means comprises another capacitive component in parallel connection with respect to said serially connected resistive and capacitive components.

12. The quench strobe of claim 10 wherein said filter means comprises another capacitive component in connection only with respect to said resistive component.

13. A quench strobe comprising:

a flash tube;

circuit means responsive to an applied trigger signal for effecting a discharge of current through said flash tube to produce an illuminating flash of light;

quench means responsive to another subsequently applied trigger signal for extinguishing said flash of light, said quench means having a predetermined reaction time from receipt of said other trigger signal to full extinguishment of said illuminating flash of light;

a photoresponsive element;

an operational amplifier having two input terminals connected across said photoresponsive element to operate in a current mode, said amplifier further comprising an output terminal;

feedback means interconnecting the output terminal of said amplifier to one of said input terminals to provide an output signal at said output terminal representative of the integral of the light intensity incident to said photoresponsive element as anticipated by a predetermined time corresponding to said reaction time of said quench means; and level detecting means responsive to said output terminal reaching a select level for providing said other trigger signal.

14. The quench strobe of claim 13 wherein said feedback means comprises a resistive and capacitive component serially connected with respect to each other to provide said anticipation time together with means for filtering the light integration signal from said resistive and capacitive components.

15. The light integrator of claim 14 wherein said filter means comprises another capacitive component in parallel connection with respect to said serially connected resistive and capacitive components.

16. The light integrator of claim 14 wherein said filter means comprises another capacitive component in connection only with respect to said resistive component.

* * * * *